United States Patent [19]

Keller et al.

[11] Patent Number: 4,503,802

[45] Date of Patent: Mar. 12, 1985

[54] DEVICE FOR UNIFORMLY APPLYING SMALL AMOUNTS OF FLUID TO MOVING WEBS

[75] Inventors: Walter Keller, Willich; Johannes Kutz; Gerhard Severens, both of Tonisvorst, all of Fed. Rep. of Germany

[73] Assignee: Eduard Küsters, Krefeld, Fed. Rep. of Germany

[21] Appl. No.: 466,492

[22] Filed: Feb. 15, 1983

[30] Foreign Application Priority Data

Feb. 19, 1982 [DE] Fed. Rep. of Germany ..... 3205911

[51] Int. Cl.[3] ..... B05C 1/08

[52] U.S. Cl. ..... 118/249; 118/250; 118/258; 118/259; 118/262; 427/428

[58] Field of Search ..... 118/249, 259, 262, DIG. 15, 118/250, 258; 29/121.1, 132; 427/428

[56] References Cited

U.S. PATENT DOCUMENTS

| | | | |
|---|---|---|---|
| 2,288,720 | 7/1942 | Knowlton | 118/259 |
| 3,222,209 | 12/1965 | Brundige | 29/132 |
| 3,301,156 | 1/1967 | Roeber | 118/249 |
| 3,592,134 | 7/1971 | Patterson | 29/132 |
| 3,874,331 | 4/1975 | Kirsen | 118/262 |

*Primary Examiner*—Shrive P. Beck

*Attorney, Agent, or Firm*—Kenyon & Kenyon

[57] ABSTRACT

In a three-roller device for uniformly coating a moving web with small quantities of fluid, the middle roller is provided with a contoured or grooved elastic covering, one of the two other rollers with a smooth elastic covering and the third with an incised elastic covering or sheath. Fluid is transferred to the middle roller from the roller which is not in contact with the moving web, the fluid being introduced either via a pool on a trough or via a spraying apparatus.

14 Claims, 4 Drawing Figures

DEVICE FOR UNIFORMLY APPLYING SMALL AMOUNTS OF FLUID TO MOVING WEBS

BACKGROUND OF THE INVENTION

This invention relates to a device, and in particular to a device comprising rollers, for applying fluid to a moving web.

Such a device is described in German patent document (Deutsche Patentschrift) Ser. No. 569,612. In that device, three rollers are disposed in a roller frame one above the other, the upper and the lower roller each having an elastic rubber covering and the middle roller having an engraved cylindrical surface. The upper and lower rollers are engageable with the middle roller at respective lines of contact or nips, the contact pressures at the nips being independently variable. A bottom portion of the lower roller is immersed during rotation thereof in a pool of liquid contained in a trough, the trough having a length equal to the width of a web passing through the upper roller slot or nip. The amount of fluid transferred to the web is controlled by varying the contact pressures at the nips and by changing the fineness of the grooves or notches engraved in the surface of the middle roller.

A device for applying liquid in small quantities to a fabric web is described in German patent document Ser. No. 197,893. This device likewise comprises a vertical array of rollers rotatable about respective parallel horizontal axes, the lowermost roller rotating in a trough extending the width of the fabric web. During rotation, the lowermost roller transfers fluid from its surface to a notched or engraved roller. Fluid sitting in the notches of this roller is removed by means of a brush roller and applied to a pair of fluid transfer rollers juxtaposed thereto, the fabric web being drawn past the transfer rollers. The transfer rollers can rotate at greater speeds than the engraved roller, the speed differential being taken up by motion relative to the brush roller. Because the two transfer rollers and the fabric web move more rapidly than the engraved roller, a determinate quantity of fluid can be distributed over a greater web length, whereby a small amount of fluid per unit of area is applicable.

Uniformity of fluid transfer is virtually unattainable in such a device, owing to the pressure by the brush and the circumstance that the fluid transfer rollers are engaged by the web only on one side, rather than at a roller nip. The brush undergoes a wear and tear which is difficult to control and which strongly influences the transfer relationships. In addition, there is no even distribution of fluid on the web, such a distribution being producable by a roller nip.

The object of this invention is to provide a three-roller device of the above-described type which can apply to a web, in a very uniform distribution, very small quantities of fluid per unit area.

SUMMARY OF THE INVENTION

A three-roller fluid applicator of the above-described type is improved, in accordance with this invention, by providing all three rollers with an elastic covering or sheath, the covering of the middle roller having a hardness of 80° to 90° Shore D, preferably approximately 86° Shore D. The covering of the middle roller is provided with annular grooves or recesses having an axial center-to-center spacing of 0.3 to 1.5 mm, preferably 0.5 to 0.9 mm, and a depth 0.3 to 1.5 times as large as the center-to-center spacing. One of the other two rollers is provided with circumferential cuts or incisions having a longitudinal spacing of 0.2 to 1 mm and a depth of 0.5 to 1.5 mm.

The combination of a smooth elastic covering on a first peripheral roller, a contoured elastic covering on a middle roller and a cut elastic covering on a second peripheral roller has enabled the finely controllable application of light or thin fluid coatings in very fine distributions.

The fluid may be transferred to the middle or contoured roller in a vertical roller array by having the lowermost roller partially immersed in a fluid bath or in a horizontal or vertical roller array by spraying fluid at a roller nip other than the nip through which the web is transported.

DETAILED DESCRIPTION

Figure 1:
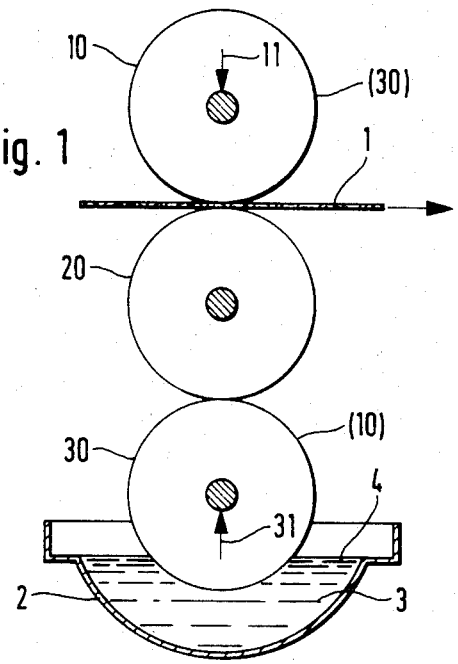
FIG. 1 is a transverse vertical cross-sectional view, partially diagrammatic, of a three-roller fluid applicator with improvements in accordance with this invention.

A device for uniformly applying small amounts of fluid to a moving fabric web 1 comprises, as illustrated in FIG. 1, an upper roller 10 with a smooth cylindrical elastic covering or sheath 21, a contoured middle roller 20 with a grooved cylindrical elastic covering 22 and a lower roller 30 with a cut cylindrical elastic covering 23. Rollers 10, 20 and 30 are disposed in a vertical array with respective horizontal axes of rotation (not illustrated), upper and middle rollers 10 and 20 engaging one another at an upper line of contact or nip 24 and middle and lower rollers 20 and 30 engaging one another along a lower line of contact or nip 25. Web 1 passes between rollers 10 and 20 at upper nip 24. The lower roller 30 has a bottom portion immersed in a pool of fluid 3 contained in a trough 4. The trough has a length substantially equal to the breadth of the fabric web 1 and is filled with fluid up to a filling level 4. Middle roller 20 is supported at its ends in a roller frame or stand (not shown), while rollers 10 and 30 are engageable with middle roller 20 under independently variable respective contact pressures represented by arrows 11 and 31.

Lower roller 30 transfers fluid from pool 3 to contoured middle roller 20. The lower roller's elastic covering or sheath 23 is provided with a multiplicity of circumferential incisions 14 (see FIG. 4), whereby lower roller 30 conforms itself particularly well to the contour of middle roller 20. Spaced circumferential incisions 14 enable elastic covering 23 of roller 30 to press into circumferential grooves or recesses 6 (see FIG. 3) provided in elastic covering 22 of middle roller 20, thereby squeezing fluid out of these grooves and ensuring that only a very limited quantity of fluid is transferred to middle roller 20 and from thence to moving fabric web 1.

As indicated by parenthetical designations (10) and (30) on the right side of FIG. 1, the positions of rollers 10 and 30 may be exchanged, in accordance with the present invention, so that smooth roller 10 serves as the liquid-transfer roller which is partially immersed in pool 3, while cut roller 30 together with middle roller 20 forms upper nip 24. In this embodiment of the invention, a larger quantity of fluid is transferred to contoured roller 20, because grooves 6 can be filled to a greater extent. Moreover, fluid applied to fabric web 1 is worked particularly well into the fabric, since cut roller 30 is matched to the circumferential grooves of the middle roller and presses the fabric web 1 partially into grooves 6.

Figure 2:
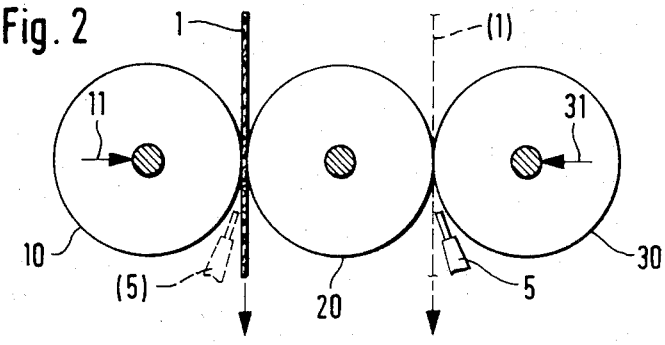
FIG. 2 is a transverse vertical cross-sectional view, partially diagrammatic, of another three-roller fluid applicator with improvements.

As illustrated in FIG. 2, a device in accordance with the present invention for uniformly applying small quantities of fluid to a moving web may comprise a smooth roller 10', a contoured roller 20' and a cut roller 30' disposed in a horizontal array. Rollers 10' and 30' engage contoured roller 20' along respective horizontally oriented lines of contact or nips 26 and 27 located at diametrically opposed sides of roller 20'. Rollers 10', 20' and 30' with respective elastic sheaths or coverings 21', 22' and 23' are structurally identical to rollers 10, 20 and 30 with elastic coverings 21, 22 and 23, respectively. The essential difference between the device illustrated in FIG. 1 and the device of FIG. 2 is that fluid is introduced, not through the partial immersion of a roller in a pool of fluid, but rather through the spraying of fluid onto a pair of rollers 10' and 20' or 20' and 30' at the respective roller nip 26 or 27. If the fabric web 1 passes through nip 26, then a spraying apparatus or nozzle 5 is directed at nip 27, as illustrated in sold lines in FIG. 2. Alternatively, if fabric web 1 passes through nip 27, spraying apparatus 5 is juxtaposed to nip 27, as illustrated by dashed lines in FIG. 2. In either case, web 1 moves downwardly while fluid is simultaneously sprayed upwardly by apparatus 5 along a length of the nip corresponding to the width of the web. Of course, contoured roller 20' rotates in opposite directions in the two cases, always moving downwardly with web 1 at the nip 26 or 27 through which the web passes. It is to be noted that a greater quantity of fluid is applied to the moving web when it is being drawn through nip 27 than when it is being drawn through nip 26.

Figure 3:
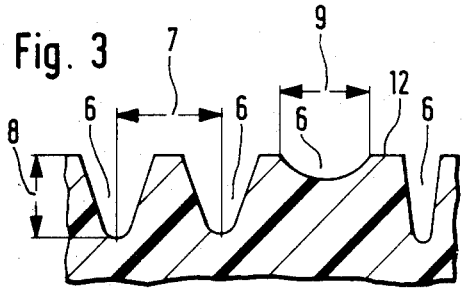
FIG. 3 is a partial longitudinal or axial cross-sectional view of an elastic covering or sheath of a middle roller shown in FIG. 1.

The form and disposition of the circumferential grooves 6 provided in elastic covering 22 (or 22') of roller 20 (or 20') are illustrated in FIG. 3. The grooves have an axial or longitudinal center-to-center spacing 7 of 0.3 to 1.5 mm, preferably 0.5 to 0.9 mm, and a depth 8 of 0.3 to 1.5 times the center-to-center spacing. As shown in the right half of FIG. 3, grooves of a predetermined center-to-center spacing 7 may range in depth from very shallow to very deep. Grooves 6 have a mouth or outer surface width 9 limited in magnitude by center-to-center spacing 7, it being preferable that a portion of the original outer surface 12 of the elastic sheath 22 remain between adjacent circumferential grooves 6 upon the formation thereof.

Elastic covering 22 (or 22') of contoured roller 20 (or 20'), and in particular the outer portion of the covering, has a hardness of 80° to 90° Shore D, preferably approximately 86° Shore D. Elastic coverings 21 and 23 (or 21' and 23') have a hardness in the same range as sheath 22, preferably 86° Shore D.

Figure 4:
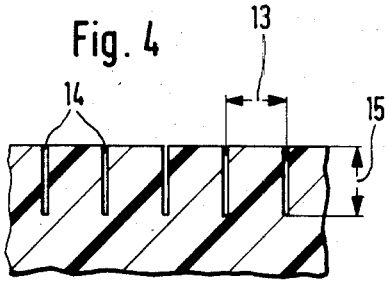
FIG. 4 is a partial longitudinal or axial cross-sectional view of an elastic covering of a peripheral roller shown in FIG. 1.

As illustrated in FIG. 4, circumferential incisions or cuts 14 have an axial or longitudinal spacing 13 of 0.2 to 1 mm and a depth 15 of 0.5 to 1.5 mm, preferably approximately 1.0 mm.

Fluid contained in trough 4 (or sprayed by apparatus 5) and applied to web 1 may be a dye, or a finishing liquid. Web 1 may be a woven or knitted textile sheet, a nonwoven or formed fabric, a carded web, a paper web or a yarn material.

A roller diameter of approximately 200 mm was used in experiments for all three rollers 10, 20 and 30 (or 10', 20' and 30'). With a shirt poplin of 100 g per square meter, basic weight, coatings of 10% to 80% were achieved, the lower coatings being especially significant. With polyester, with applications of approximately 40%, dye migration occurs. In order to avoid this aspect, smaller applications are required, which are difficult and expensive to distribute uniformly be conventional processes, but which present no problems when the devices of FIGS. 1 and 2 are used. Uniformly distributed applications of 15% to 40% are attainable in textile materials of 350 g basic weight by means of devices in accordance with the present invention.

In order to adapt the devices of FIGS. 1 and 2 to different applications, it is important that the linear contact pressures at nips 24 and 25 (or 26 and 27) are independently variable, in order to control, on the one hand, the transfer of fluid to middle roller 20 (or 20') and, on the other hand, the transfer of fluid from the middle roller to web 1.

What is claimed is:

1. In a device for uniformly applying small quantities of fluid to a moving web, said device comprising a contoured first roller and a pair of second rollers engaging said first roller at diametrically opposed sides thereof, said second rollers having elastic coverings, said web moving between said first roller and one of said second rollers at a nip formed thereby, the other of said second rollers serving to transfer fluid, the improvements wherein:

the first roller is provided with an elastic covering having a hardness of 80° to 90° Shore D;

the elastic covering of said first roller is provided with circumferential grooves having an axial center-to-center spacing of 0.3 to 1.5 mm and a depth 0.3 to 1.5 times as large as the center-to-center spacing; and one of the second rollers is provided with circumferential incisions having a longitudinal spacing of 0.2 to 1 mm and a depth of 0.5 to 1.5 mm.

2. The improvement defined in claim 1 wherein the hardness of the elastic covering of said first roller is approximately 86° Shore D and the axial center-to-center spacing of said grooves is between 0.5 and 0.9 mm.

3. The improvement defined in claim 2 wherein the elastic coverings of said second rollers have a hardness of 80° to 90° Shore D.

4. The improvement defined in claim 3 wherein the elastic coverings of said second rollers have a hardness of approximately 86° Shore D.

5. The improvement defined in claim 4 wherein one of said second rollers is partially immersed in a pool of fluid and the web moves between said first roller and the other of said second rollers at a nip formed thereby.

6. The improvement defined in claim 4 wherein, proximate to a nip formed by said first roller and one of said second rollers, means are disposed for spraying fluid at such nip, the web moving through a nip formed by said first roller and the other of said second rollers.

7. The improvement defined in claim 1 wherein the elastic coverings of said second rollers have a hardness of 80° to 90° Shore D.

8. The improvement defined in claim 7 wherein the elastic coverings of said second rollers have a hardness of approximately 86° Shore D.

9. The improvement defined in claim 3 wherein one of said second rollers is partially immersed in a pool of fluid and the web moves between said first roller and the other of said second rollers at a nip formed thereby.

10. The improvement defined in claim 2 wherein one of said second rollers is partially immersed in a pool of fluid and the web moves between said first roller and the other of said second rollers at a nip formed thereby.

11. The improvement defined in claim 1 wherein one of said second rollers is partially immersed in a pool of fluid and the web moves between said first roller and the other of said second rollers at a nip formed thereby.

12. The improvement defined in claim 3 wherein, proximate to a nip formed by said first roller and one of said second rollers; means are disposed for spraying fluid at such nip, the web moving through a nip formed by said first roller and the other of said second rollers.

13. The improvement defined in claim 2 wherein, proximate to a nip formed by said first roller and one of said second rollers, means are disposed for spraying fluid at such nip, the web moving through a nip formed by said first roller and the other of said second rollers.

14. The improvement defined in claim 1 wherein, proximate to a nip formed by said first roller and one of said second rollers, means are disposed for spraying fluid at such nip, the web moving through a nip formed by said first roller and the other of said second rollers.

* * * * *